US005427483A

United States Patent [19]

Wünsch et al.

[11] Patent Number: 5,427,483

[45] Date of Patent: Jun. 27, 1995

[54] ELECTRIC HAND PLANE WITH PLANING DEPTH ADJUSTER

[75] Inventors: Steffen Wünsch, Holzgerlingen; Eugen Hild, Aichtel; Karl-Heinz Braunbach, Hornbach; Kai-Uwe Flöttmann, Gütersloh, all of Germany

[73] Assignee: Robert Bosch GmbH, Stuttgart, Germany

[21] Appl. No.: 137,111

[22] PCT Filed: Feb. 10, 1993

[86] PCT No.: PCT/DE93/00110

§ 371 Date: Nov. 2, 1993

§ 102(e) Date: Nov. 2, 1993

[87] PCT Pub. No.: WO93/15885

PCT Pub. Date: Aug. 19, 1993

[30] Foreign Application Priority Data

Feb. 18, 1992 [DE] Germany ..... 42 04 775.7

[51] Int. Cl.[6] ..... B27C 1/10

[52] U.S. Cl. ..... 409/178; 30/475; 144/117 C

[58] Field of Search ..... 409/178, 175, 204, 308; 30/475; 144/117 C, 134 D, 136 C, 136 D, 136 G; 51/170 PT

[56] References Cited

U.S. PATENT DOCUMENTS

| | | | |
|---|---|---|---|
| 2,600,279 | 6/1952 | Spitzley . | |
| 3,407,857 | 10/1968 | Bentley . | |
| 4,360,048 | 11/1982 | Schädlich et al. | 30/475 |
| 4,382,729 | 5/1983 | Bachmann | 409/178 |
| 4,555,850 | 12/1985 | Frech | 30/490 |
| 4,693,648 | 9/1987 | Cavedo | 409/178 |

FOREIGN PATENT DOCUMENTS

| | | | |
|---|---|---|---|
| 563376 | 12/1923 | France . | |
| 1520140 | 4/1968 | France . | |
| 2150152 | 3/1973 | France . | |
| 1024232 | 2/1958 | Germany . | |
| 3441943 | 5/1986 | Germany | 409/178 |
| 263087 | 11/1949 | Switzerland . | |

*Primary Examiner*—Z. R. Bilinsky
*Attorney, Agent, or Firm*—Michael J. Striker

[57] ABSTRACT

An electric hand plane has a wedge-shaped body having a lower wedge surface adapted to rest on a workpiece and an upper wedge surface, a plane housing supported on the upper wedge surface of the wedge-shaped body and having a counter-surface, a device for producing a clamping force between the upper wedge surface of the wedge-shaped body and the counter-surface of the housing, and a single handle operative for cancelling the clamping force during an adjustment and also for displacement of the wedge-shaped body, and a gear mechanism means arranged so that the handle displaces the wedge-shaped body relative to the plane housing via the gear mechanism means by rotation.

12 Claims, 2 Drawing Sheets

ELECTRIC HAND PLANE WITH PLANING DEPTH ADJUSTER

BACKGROUND OF THE INVENTION

The present invention relates to an electric hand plane with a planing depth adjuster.

More particularly it relates to an electric hand plane which has a wedge-shaped body with a lower surface resting on a workpiece and an plane housing supported on an upper wedge surface and a device producing a clamping force between the upper wedge surface and a counter-surface of the plane housing.

A hand plane of the generic type is known from U.S. Pat. No. 4,555,850. Its planing depth adjusting device with planing depth indicator is formed by a single handle coupled with a wedge-shaped body which can slide back and forth at the underside of the hand plane which has the form of an oblique plane. The problem of adjusting the planing depth is solved in this hand plane in a relatively simple way and in an economical manner in terms of design and manufacture. However, this hand plane has the disadvantage that an accurate adjustment of the planing depth requires a relatively sensitive touch and is time consuming.

SUMMARY OF THE INVENTION

Accordingly, it is an object of the present invention to provide an electric hand plane with a planing depth adjuster, which avoids the disadvantages of the prior art.

In keeping with these objects and with others which will become apparent hereinafter, one feature of the present invention resides, briefly stated, in an electric hand plane of the above mentioned type having a single handle, wherein the handle displaces the wedge-shaped body relative to the plane housing via gear mechanism parts, in particular by rotation.

When the electric hand plane is designed in accordance with the present invention, it has the advantage over the prior art that the planing depth can be adjusted quickly in a particularly exact and controlled manner.

The improved convenience increases the use value of the hand plane to such a considerable extent that the increased design and manufacturing cost is negligible.

In accordance with another feature of the present invention the gear mechanism parts are moved relative to one another by rotating the handle around the axis. The gear mechanism parts can include at least one toothed rack which is arranged preferably to be stationary in the interior of the plane housing, and a toothed wheel which meshes with the latter and is supported to be rotatable in the wedge-shaped body.

The handle can carry a toothed rim which is fixed with respect to rotation relative to it and meshes with an edge region of the recess in the form of a toothed rack. The handle can simultaneously serve as an auxiliary handle which projects upward out over the plane housing and follows the movement of the wedge-shaped body, and the wedge-shaped body can be held at the plane housing without play by the force of at least one spring.

The handle, and/or the wedge shaped body can be arranged at opposite ends of the axle to be rotatable and springing in the axial direction so that the handle and the wedge-shaped body tend toward one another and clamp the plane housing between them.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
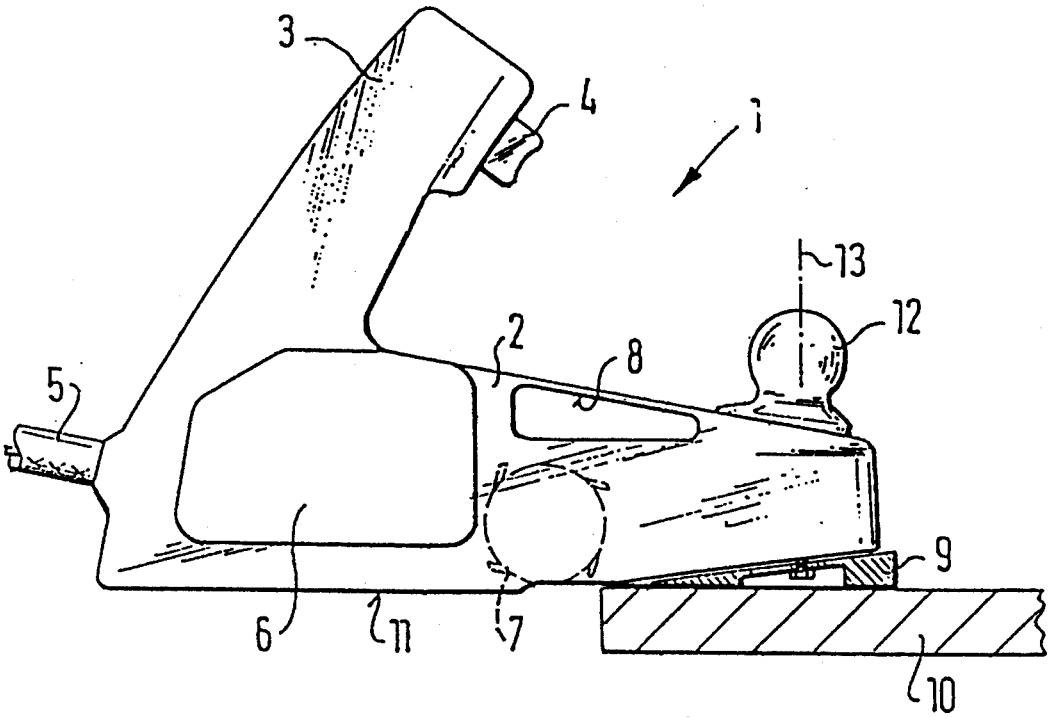
FIG. 1 shows a side view of a hand plane according to the invention.

FIG. 1 shows the construction of an embodiment example of a hand plane 1 having a plane housing 2 with a main handle 3 in which an on/off switch 4 is arranged. An electric cable 5 leading out of the rear area of the hand plane 1 is connected in the interior of the hand plane housing 2 with an electric motor which is not shown in particular. The accommodation of the electric motor is suggested by the contour of the motor housing 6. A planing cylinder with planing knives 7 is shown schematically in the central region of the hand plane 1. A chip ejection opening 8 is arranged above the planing cylinder. The hand plane 1 sits on a workpiece 10 on its wedge-shaped body 9 which is arranged in the front region of the hand plane 1. In this instance, the maximum cutting depth is adjusted as determined by the step in the base 11 of the hand plane 1 near the planing cylinder 7. The hand plane 1 has a front handle 12 which displaces the wedge-shaped body 9 and changes the cutting depth when rotated around its axis 13.

Figure 2:
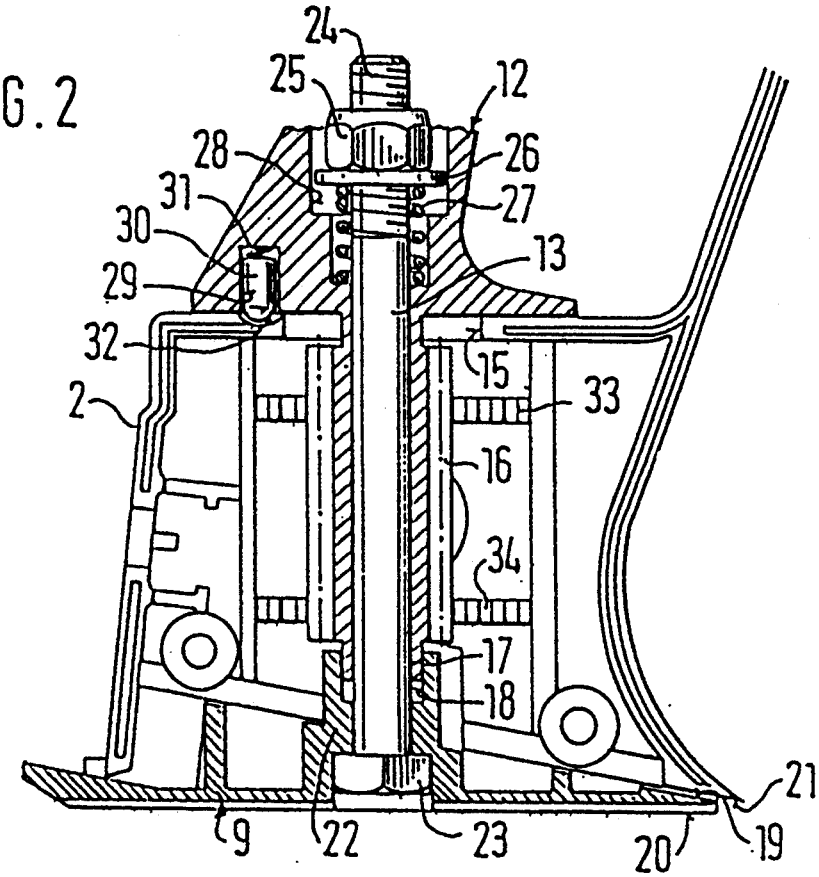
FIG. 2 shows a sectional view from the side of the front region of the hand plane.

FIG. 2 shows the front region of the hand plane 1 with a plane housing 2 having the handle 12 which projects out and upward over the plane housing 2 and also serves as an auxiliary handle. The handle 12 is rotatable around the axle 13 and displaceable in a slot-like recess 15 of the plane housing 2. The handle 12 projects into the plane housing 2 with a cylindrical continuation constructed as a toothed roll 16. The toothed roll 16 projects with its free end 17 into a receptacle bore hole 18 of the wedge-shaped body 9. This wedge-shaped body 9 has an upper wedge surface 19 and a lower support surface 20. The wedge-shaped body 9 is supported by its upper wedge surface 19 at the opposite surface or counter-surface 21 of the plane housing 2 which has an oblique plane.

The receptacle bore hole 18 is located in a barrel-shaped continuation 22 of the wedge-shaped body 9 in which the axle 13, which is constructed as a screw bolt, is arranged so as to be fixed with respect to rotation by a hexagon head 23. The axle 13 passes through the center of the toothed roll 16 and the handle 12 at which it is secured axially by its free end. For this purpose, the free end of the axle 13 is provided-with a thread 24 on which a hexagon nut 25 is screwed. A pressure spring 27 is supported against the hexagon nut 25 via a washer 26 and, on the side opposite the washer 26, in a stepped bore hole 28 of the handle 12.

A locking pin 30 is tightly guided into a pocket bore hole 29 parallel to the axle 13 so as to be displaceable axially. The locking pin 30 is supported against a spring 31 in the back and projects into one of the locking recesses 32 of the plane housing 2.

The toothed roll 16 engages with its outer tooth area in two toothed racks 33, 34 which are fixed in the plane housing 2 in a parallel arrangement relative to one another.

The lower, base-like wedge surface 20 of the wedge-shaped body 9 rests on a workpiece, not shown, and determines the distance between the planing cylinder, not shown, and the surface of the workpiece and accordingly also determines the cutting depth. Thus, the farther the wedge-shaped body 9 is moved toward the front, the farther the lower wedge surface 20 is moved upward and the greater the cutting depth.

If the handle 12 is rotated around the axle 13, the other tooth region of the toothed roll 16 rolls on the tooth regions of the toothed racks 33, 34. The rotation is accordingly transformed without slippage into a translational movement due to the positive-locking engagement so that the handle 12 is displaced along the toothed racks 33, 34 and along the slot-like recess 15 together with the toothed roll 16, the axle 13, and the wedge-shaped body 9.

The wedge-shaped body 9 is fixed in position transversely relative to the direction of displacement by its upper wedge surface 19 at the counter-surface 21 at the housing 2 by ribs and grooves, not shown, which extend parallel to the direction of displacement. Similarly, the handle 12 is guided in the slot-like recess 15 of the plane housing 2 to prevent a deflection transverse to the displacement direction at least at two opposite sides, so that the toothed roll 16 is always held against the toothed racks 33, 34 with slight play.

Since the axle 13 secures the handle 12 and/or the wedge-shaped body 9 at opposite ends so as to be axially displaceable via a spring, the handle 12 and the wedge-shaped body 9 tend toward one another and, in so doing, clamp the plane housing 2 between them. This results in an elastic longitudinal compensation for the position of the wedge-shaped body 9 with reference to the axle 13 and handle 12. With each adjustment of the planing depth, the wedge-shaped body 9 is tightened against the oblique-plane counter-surface 21 of the housing 2 and can follow along with every change in position normal to the plane housing 2 without play.

Figure 3:
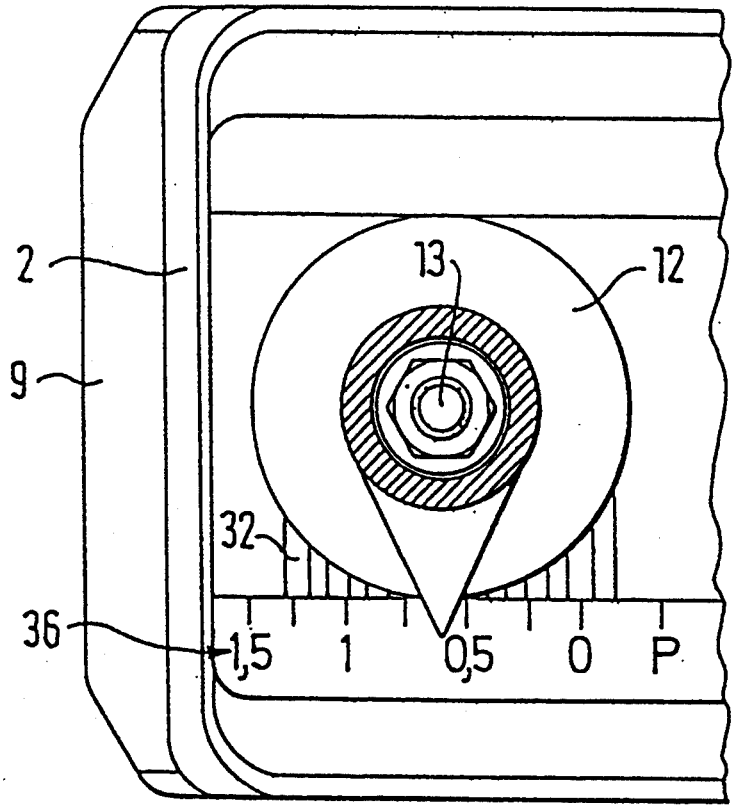
FIG. 3 shows a top view of this region of the hand plane.

The top view in FIG. 3 of the embodiment example according to FIG. 2 shows the arrangement of the handle 12 and the locking recesses 32. It also shows a pointer-like marker support 35 which is arranged at the axle 13 so as to be fixed with respect to rotation relative to it and whose position relative to a graduated scale 36 allows an accurate adjustment of a determined cutting depth dimension between 0 and 1.5 mm. Further, P designates a "parking position" in which the hand plane 1 can be laid down without risk of injury due to a possible unintentional starting of the planing cylinder 7 with planing knives.

In an embodiment example of the invention which is not shown in the drawing, a crank mechanism is arranged at the handle instead of the toothed roll and toothed racks. This crank mechanism is supported in the interior of the plane housing and, in principle, has the same effect as the toothed gear mechanism.

In another embodiment example which is not shown in the drawing, a swivel lever carrying the handle is supported by one end in the wedge-shaped body in an articulated manner in place of the axle according to FIG. 2. The swivel lever is supported at the housing in the vicinity of the bearing in the manner of a rocker at an axle which is rigid with respect to the housing. Accordingly, a two-armed lever is formed, whose swiveling movement must be followed by the wedge-shaped body. The wedge-shaped body is displaced by swiveling the handle in and opposite the feed direction. An elastic longitudinal compensation can be produced between the swivel lever and the wedge-shaped body in a manner analogous to the embodiment example according to FIG. 2.

It will be understood that each of the elements described above, or two or more together, may also find a useful application in other types of constructions differing from the types described above.

While the invention has been illustrated and described as embodied in an electric hand plane with a planing depth adjusting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An electric hand plane, comprising a wedge-shaped body having a lower wedge surface adapted to rest on a workpiece and an upper wedge surface; a plane housing supported on said upper wedge surface of said wedge-shaped body and having a counter-surface; a device for producing a clamping force between said upper wedge surface of said wedge-shaped body and said counter-surface of said housing; and a single handle operative for cancelling the clamping force during an adjustment and also for displacement of said wedge-shaped body; and gear mechanism means arranged so that said handle displaces said wedge-shaped body relative to said plane housing via said gear mechanism means by rotation, said housing having a recess with an edge region formed as a toothed rack, said handle carrying a toothed rim which is fixed with respect to rotation relative to said handle and meshes with said toothed rack.

2. An electric hand plane, comprising a wedge-shaped body having a lower wedge surface adapted to rest on a workpiece and an upper wedge surface; a plane housing supported on said upper wedge surface of said wedge-shaped body and having a counter-surface; a device for producing a clamping force between said upper wedge surface of said wedge-shaped body and said counter-surface of said housing; and a single handle operative for cancelling the clamping force during an adjustment and also for displacement of said wedge-shaped body; and gear mechanism means arranged so that said handle displaces said wedge-shaped body relative to said plane housing via said gear mechanism means by rotation, said gear mechanism means including a plurality of gear mechanism parts which are moved relative to one another by rotating said handle around an axle.

3. A hand plane as defined in claim 2, wherein said handle simultaneously forms an auxiliary handle which projects upwards out over said plane housing and follows the movement of said wedge-shaped body.

4. A hand plane as defined in claim 2; and further comprising a spring which holds said wedge-shaped body at said housing without play.

5. A hand plane as defined in claim 2, wherein said plane housing has a slot-like recess which tightly grasps said handle at least on two opposite sides and guides said wedge-shaped body along said recess.

6. A hand plane as defined in claim 2, wherein said wedge-shaped body is provided with a barrel-shaped continuation, said handle having a free end supported in said barrel-shaped continuation so as to be rotatable, said axle having a free end which is supported in said barrel-shaped continuation so as to be fixed with respect to rotation relative to it.

7. A hand plane as defined in claim 2, wherein said handle and wedge-shaped body are arranged at opposite ends of said axle so as to be rotatable and springing in an axial direction, so that said handle and said wedge-shaped body tend toward one another and therefore clamp said plane housing between them.

8. A hand plane as defined in claim 2; and further comprising a locking device arranged so that said handle is supported relative to said plane housing via said locking device.

9. A hand plane as defined in claim 2; and further comprising a graduated scale provided at said housing; and a pointer-like mark indicator arranged at said handle and determining a position of said wedge-shaped body and accordingly a planning depth in connection with said graduated scale.

10. An electric hand plane, comprising a wedge-shaped body having a lower wedge surface adapted to rest on a workpiece and an upper wedge surface; a plane housing supported on said upper wedge surface of said wedge-shaped body and having a counter-surface; a device for producing a clamping force between said upper wedge surface of said wedge-shaped body and said counter-surface of said housing; and a single handle operative for cancelling the clamping force during an adjustment and also for displacement of said wedge-shaped body; and gear mechanism means arranged so that said handle displaces said wedge-shaped body relative to said plane housing via said gear mechanism means by rotation, said gear mechanism means including at least one toothed rack which is arranged in an interior of said plane housing and a toothed wheel which meshes with said toothed rack and is supported so as to be rotatable in an interior of said wedge-shaped body.

11. A hand plane as defined in claim 10, wherein said toothed rack is arranged stationary in the interior of said plane housing.

12. A hand plane as defined in claim 10, wherein said wedge-shaped body is provided with a barrel-shaped continuation, said toothed wheel of said gear mechanism parts having a free end supported in said barrel-shaped continuation so as to be rotatable, said axle having a free end which is supported in said barrel-shaped continuation so as to be fixed with respect to rotation relative to it.

* * * * *